US007017679B2

(12) United States Patent
Sollinger et al.

(10) Patent No.: US 7,017,679 B2
(45) Date of Patent: Mar. 28, 2006

(54) DEVICE FOR THE CONTINUOUS ADJUSTMENT OF UNBALANCE OF STEERABLE VIBRATION PLATES

(75) Inventors: Josef Sollinger, Mallersdof-Pfaffenberg (DE); Norbert Jungwirth, Unterschleissheim (DE)

(73) Assignee: Wacker Construction Equipment AG, Munich (DE)

( * ) Notice: Subject to any disclaimer, the term of this patent is extended or adjusted under 35 U.S.C. 154(b) by 107 days.

(21) Appl. No.: 10/416,874

(22) PCT Filed: Nov. 21, 2001

(86) PCT No.: PCT/EP01/13557

§ 371 (c)(1),
(2), (4) Date: May 15, 2003

(87) PCT Pub. No.: WO02/42010

PCT Pub. Date: May 30, 2002

(65) Prior Publication Data

US 2004/0035104 A1 Feb. 26, 2004

(30) Foreign Application Priority Data

Nov. 22, 2000 (DE) ..... 200 19 823 U

(51) Int. Cl.
*E21B 7/24* (2006.01)

(52) U.S. Cl. ..... 173/49; 60/484; 74/87; 404/133.05; 404/130; 404/113

(58) Field of Classification Search ..... 404/133.05, 404/133.1, 133.2, 130, 102, 113, 117, 118; 173/49, 55; 74/86, 87; 60/484
See application file for complete search history.

(56) References Cited

U.S. PATENT DOCUMENTS 3,564,932 A * 2/1971 Bebelle ..... 74/61

(Continued)

FOREIGN PATENT DOCUMENTS

EP 0 070 345 A 1/1983

(Continued)

*Primary Examiner*—Stephen F. Gerrity
*Assistant Examiner*—Thanh Truong
(74) *Attorney, Agent, or Firm*—Boyle Fredrickson Newholm Stein & Gratz S.C.

(57) ABSTRACT

The invention relates to steerable vibration plates that are set vibrating by rotating unbalanced masses. By twisting the unbalanced masses relative to one another the resulting forces and their direction of action can be changed, thereby influencing the travel speed of the vibrating plate and its direction of travel. The inventive vibration plate is characterized in that the unbalanced masses disposed on a common shaft can be adjusted independent of external forces and torques since the adjustment piston adjusting the unbalanced masses is braced in the adjustment cylinder to a much higher degree than would be possible with conventional coil springs. To this end, every adjustable unbalanced mass is associated with a double-action hydraulic cylinder that comprises two liquid chambers. The connection of said chambers to a storage and a pump can be locked in order to fix the piston which can be adjusted within the hydraulic cylinder.

19 Claims, 1 Drawing Sheet

U.S. PATENT DOCUMENTS 3,990,522 A * 11/1976 Pyles et al. ..... 173/78
4,105,356 A * 8/1978 Loveless ..... 404/117
4,382,715 A * 5/1983 Vural et al. ..... 404/133.05
4,458,485 A * 7/1984 Seelmann ..... 60/421
4,694,649 A * 9/1987 Howeth ..... 60/468
4,759,659 A 7/1988 Copie
4,771,645 A * 9/1988 Persson ..... 74/61
4,773,217 A * 9/1988 Angot et al. ..... 60/444
4,779,418 A * 10/1988 Artzberger ..... 60/444
4,830,597 A * 5/1989 Steier et al. ..... 425/456

FOREIGN PATENT DOCUMENTS

EP 0 951 949 A 10/1999

* cited by examiner

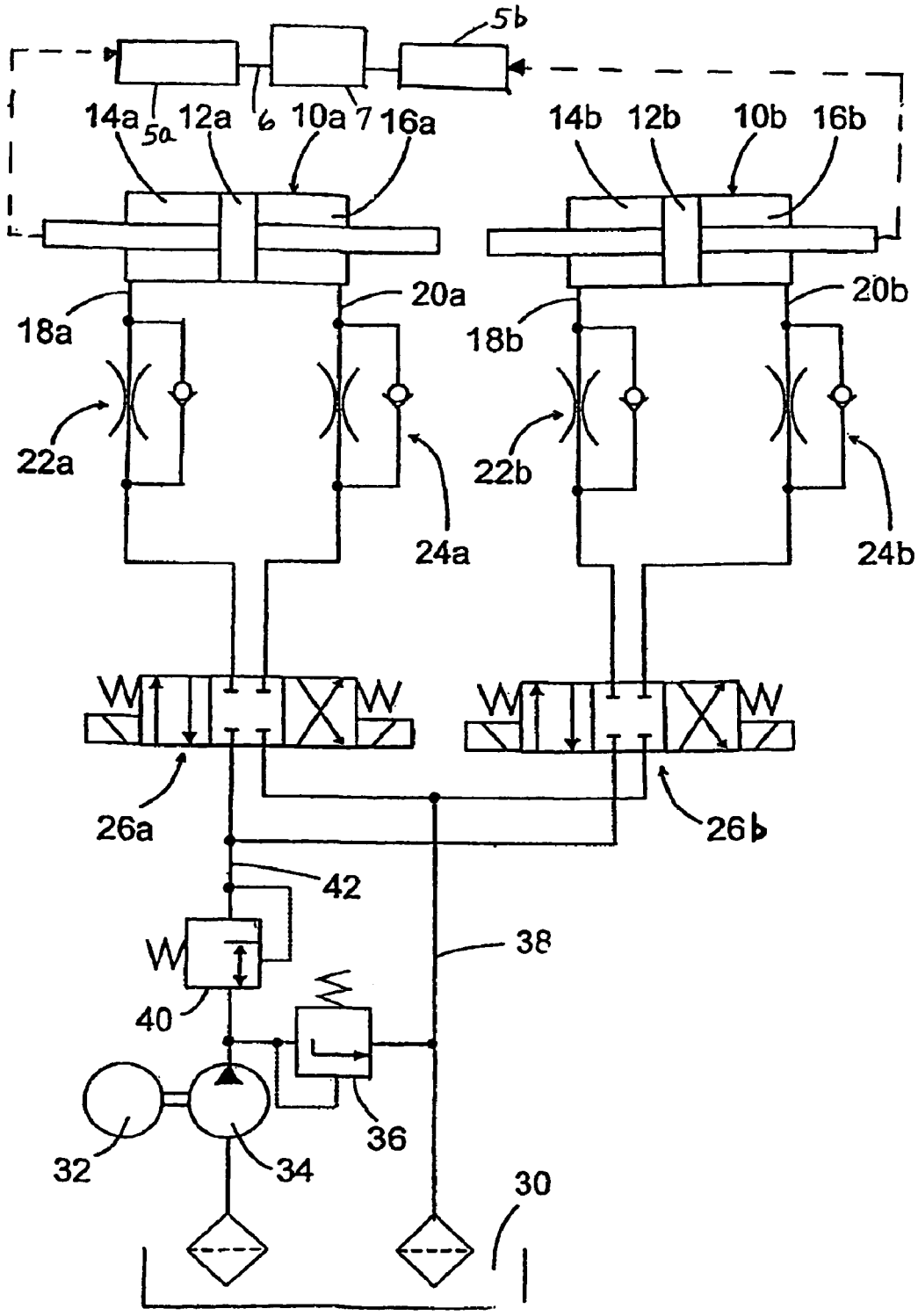
5b
14a
5a
12a
6
10a
7
16a
14b
12b
10b
16b
18a
20a
18b
20b
22a
22b
24a
24b
26a
26b
42
38
40
36
32
34
30

DEVICE FOR THE CONTINUOUS ADJUSTMENT OF UNBALANCE OF STEERABLE VIBRATION PLATES

BACKGROUND OF THE INVENTION

1. Field of the Invention

The present invention relates to a device for continuous unbalanced mass adjustment in steerable vibration plates, the device having an actuating element that is formed as a piston of a hydraulic cylinder and that stands in a working connection with the associated unbalance mass, a storage unit for hydraulic fluid, and a pressure source that comprises a delivery pump for the hydraulic fluid.

2. Description of the Related Art

Vibration plates that are suitable for use as soil compacting devices are set into vibration by rotating unbalanced masses. Through rotation of the unbalanced masses relative to one another, it is known to modify the resulting forces that occur and their direction of action, and in this way to influence the travel speed of the vibration plate and its direction of motion. Up to now, the adjustment of the two unbalanced masses has taken place using a respective single-acting hydraulic cylinder to which there is allocated a return spring in order to produce the restoring force. In this way, in theory the manipulated variable allocated to each hydraulic cylinder can be set arbitrarily by increasing the pressure in each of the two cylinders until the spring has undergone a defined shortening, in accordance with its spring characteristic, and, in this position on the piston that can be moved in the cylinder, creates an equilibrium between hydraulic force and spring force.

However, in practical operation, this equilibrium of forces is disturbed, and restoring moments are superposed on it that are neither constant nor linear and thus cannot be compensated. Causes of this can be for example restoring moments of the drive motor and/or reaction forces of the soil; an oscillation of the spring can occur, or effects of the inertia of the piston can become effective if the machine is exposed to extreme impacts.

From EP-A-0 070 345, an unbalance vibrator is known that has an adjustable flyweight. The unbalance vibrator has two unbalance shafts that can rotate in directions counter to one another, of which one has a fixedly attached flyweight and the other has a cylinder oriented transversely to the unbalance shaft. In the cylinder, a piston that acts as a flyweight is housed. Optionally, a pressure medium can be provided to the one side or the other side of the piston, and the piston can thereby be pressed into an end position. When pressure impinges on the piston from both sides, the piston can be hydraulically locked in its middle position. The unbalance vibrator can be used in a vibration plate for modifying the direction of travel in the forward and backward direction.

OBJECTS AND SUMMARY OF THE INVENTION

In order to enable an exact controlling of a vibration plate, the object of the present invention is to enable a continuous adjustment of the unbalanced masses or "unbalanced" mass, which are preferably situated on a common shaft, independent of external forces and moments. For this purpose, it is necessary to fix the piston operator in the adjustment cylinder much more rigidly than is possible with the conventionally used coil spring.

The solution according to the present invention of this problem is that there is allocated to each adjustable unbalanced mass a double-acting hydraulic cylinder having two fluid chambers, of which, for the displacement of a piston, the one can optionally be connected with the delivery pump, and at the same time the other can be connected directly with the storage unit, while, in order to fix the piston in its position, both fluid chambers can be sealed simultaneously against the storage unit and the pump.

Because the hydraulic fluid can be compressed only to a very slight degree, the closing of the lines results in the enclosing of the fluid in the line segments adjacent to the fluid chambers, with maintenance of the high pressure (35 to 40 bar) that prevails during the pump operation, whereby the pistons are fixed on both sides by an enclosed quantity of fluid under high pressure. The pistons cannot be moved from their set position by external effects, mass forces or restoring moments, because such external forces are not sufficient to overcome the existing fluid pressure. Here the possibility simultaneously arises of creating a closed control loop through the use of a suitable displacement-measuring device, which enables the realization of arbitrary defined curve radii, and even stationary compression.

Preferably, there is allocated to each double-acting cylinder a 4/3-way valve that is connected with a pressure fluid source, a fluid storage unit, and each of the two fluid chambers of the cylinder.

According to a particularly advantageous construction, each fluid chamber is connected with the 4/3-way valve via a throttle non-return valve.

BRIEF DESCRIPTION OF THE DRAWINGS

The present invention is explained in more detail on the basis of the hydraulic circuit shown in the drawing.

DETAILED DESCRIPTION OF THE PREFERRED EMBODIMENTS

The exemplary embodiment shows two double-acting hydraulic cylinders 10*a* and 10*b*, each of which acts as a servomotor in order to enable the optional and continuous adjustment, via a suitable mechanical connection, of the position of an unbalanced mass, borne by a shaft, of a vibration plate between two end positions. In each of hydraulic cylinders 10*a* and 10*b* a piston 12*a* or 12*b* can be moved in linear fashion, and at the two sides of this piston there are situated fluid chambers 14*a* and 16*a*, or 14*b* and 16*b*. The pistons 12*a* and 12*b* are operatively connected to respective unbalanced masses 5*a* and 5*b* operating on a common shaft to impart vibration to a vibration plate 7. Each of the fluid chambers 14*a* to 16*b* has a line terminal 18*a*, 20*a*, or 18*b*, 20*b*, that leads, via a throttle non-return valve 22*a*, 24*a*, or 22*b*, 24*b*, to a respective 4/3-way valve 26*a* or 26*b* allocated to each of cylinders 10*a* and 10*b*.

Each of these 4/3-way valves 26*a* and 26*b* has four terminals and three positions. The position shown is the blocking position, in which line terminals 18*a* to 20*b* are interrupted.

When valve elements of valves 26 *a* and 26*b* are moved to the right, line terminals 18*a* and 18*b* are charged with pressure fluid that is delivered from a storage unit 30 by a pump 34 that can be driven by a motor 32. The delivery side of pump 34 is connected, via a pressure limiting valve 36, with a backflow 38 that leads to storage unit 30, and is connected with valves 26*a* and 26*b* via a pressure control valve 40 and a delivery line 42.

In this position of 4/3-way valves 26*a* and 26*b*, line terminals 20*a* and 20*b* are simultaneously connected with backflow 38.

Left fluid chambers 14*a* and 14*b* are charged with hydraulic fluid under pressure, which thereby moves pistons 12*a* and 12*b* to the right, thus displacing the fluid situated in fluid chambers 16*a* and 16*b*. All the displaced fluid must pass the throttle branches of valves 24*a* or 24*b*, which produces a resistance that brakes the piston motion in cylinders 10*a* and 10*b*. The speed of the motion of pistons 12*a* and 12 can be influenced by the dimensioning of the throttle branches and of the delivery pressure set at valve 40.

As soon as pistons 12*a* and 12*b* have reached the desired position, 4/3-way valve 26*a* or 26*b* is guided into the depicted blocking position, preventing further movement of fluid between 4/3-way valves 26*a*, 26*b* and cylinders 10*a* or 10*b*. Accordingly, pistons 12*a* or 12*b* are blocked in the position that they have assumed during the closing of valves 26*a* or 26*b*.

If the valve elements in 4/3-way valves 26*a* and 26*b* are moved to the left out of the blocking position, delivery line 42 is connected with right fluid chambers 16*a* and 16*b*, while left fluid chambers 14*a* and 14*b* are now connected with the backflow. In the drawing, pistons 12*a* and 12*b* then travel to the left until 4/3-way valves 26*a* or 26*b* are again brought into the blocking position.

The valve elements of 4/3-way valves 26*a* and 26*b* can be adjusted completely independently of one another, so that pistons 12*a* and 12*b* are also adjusted completely independently of one another.

The invention claimed is:

1. A device for the continuous unbalanced adjustment of a steerable vibration plate, comprising:

two adjustable unbalanced masses mounted on a common shaft of the steerable vibration plate, a storage unit for hydraulic fluid, and a pressure source comprising a delivery pump for the hydraulic fluid, wherein to each of the adjustable unbalanced masses there is allocated a double-acting hydraulic cylinder having two fluid chambers, and a piston that separates the fluid chambers from one another, the piston of each cylinder is operatively connected to the unbalanced mass allocated thereto, and wherein for the displacement of the piston, one of the fluid chambers of each cylinder is selectively in fluid connection with the delivery pump and at the same time the other of the fluid chambers is selectively in fluid connection with the storage unit, and wherein, in order to fix the piston in its position, both fluid chambers are selectively sealed simultaneously from fluid connection to both the storage unit and the delivery pump.

2. The device as recited in claim 1, wherein there is allocated to each double-acting cylinder a 4/3-way valve that is connected to the delivery pump, the fluid storage unit, and each of the two fluid chambers of the cylinder.

3. The device as recited in claim 2, wherein each fluid chamber is connected to the 4/3-way valve via a throttle non-return valve.

4. The device as recited in claim 3, wherein the throttle non-return valve has a fluid throttle in a first passage, and has a non-return valve in a second passage connected in parallel to the first passage.

5. A device operable to adjust first and second adjustable unbalanced masses mounted on a common shaft on a vibration plate, comprising:

a storage unit for a hydraulic fluid;

a delivery pump having an inlet connected to the storage unit;

a first double acting hydraulic cylinder connected to the first unbalanced mass and a second double acting hydraulic cylinder connected to the second unbalanced mass, each of the first and second double-acting hydraulic cylinders having a first and a second fluid chamber and a piston that separates the first and second fluid chambers from one another, wherein the piston of the first hydraulic cylinder is configured to actuate the first unbalanced mass and the second hydraulic cylinder is configured to actuate the second unbalanced mass, wherein the position of the piston of the first double acting hydraulic cylinder is adjustable independently of the position of the piston of the second double acting hydraulic cylinder, and vice versa, and wherein, in order to displace each piston, one of the first and second fluid chambers is selectively fluidically connected to the outlet of the delivery pump and, at the same time, the other of the first and second fluid chambers is connected to the storage unit.

6. The device as recited in claim 5, wherein, in order to fix the piston of each double acting cylinder in a position, both the first and second fluid chambers thereof are selectively sealed simultaneously from both the storage unit and the delivery pump.

7. The device as recited in claim 5, further comprising:

a first 4/3 way valve and a second 4/3 way valve, the first 4/3 way valve being connected to the first double-acting hydraulic cylinder, and the second 4/3 way valve being connected to the second double acting hydraulic cylinder.

8. The device as recited in claim 7, wherein the first 4/3 way valve is connected via a first line terminal to the first fluid chamber of the first hydraulic cylinder, and wherein the first 4/3 way valve is connected via a second line terminal to the second fluid chamber of the first hydraulic cylinder.

9. The device as recited in claim 8, wherein the second 4/3 way valve is connected via a third line terminal to the first fluid chamber of the second hydraulic cylinder, and wherein the second 4/3 way valve is connected via a fourth line terminal to the second fluid chamber of the second hydraulic cylinder.

10. The device as recited in claim 9, wherein the first, second, third, and fourth line terminals each has a throttle valve and a non-return valve disposed therein.

11. The device as recited in claim 7, wherein the first and the second 4/3 way valves are selectively connected to the storage unit via a backflow.

12. The device as recited in claim 11, wherein the pump is connected via a pressure limiting valve to the backflow.

13. The device as recited in claim 7, wherein the first 4/3 way valves is adjustable independent of the second 4/3 way valve, and vice versa.

14. A method of adjusting first and second unbalanced masses mounted on a common shaft on a vibration plate, the method comprising the steps of:

providing first and second double acting hydraulic cylinders, each of which has a piston operatively connected to a respective one of the first and second unbalanced masses and first and second chambers disposed on opposite sides of the piston;

directing pressurized fluid from an outlet of a pump to the first chamber of at least one of the first and second double acting hydraulic cylinders while fluidly connecting the second chamber of the at least one double acting cylinder to an unpressurized storage unit in order to actuate the unbalanced mass associated with the at least one double acting cylinder; then operating a valve arrangement to isolate the first and second chambers of the at least one double acting hydraulic cylinder from both the outlet of the pump and the unpressurized storage unit in order to fix the piston of the at least one double acting cylinder in position.

15. The method as recited in claim 14, wherein the valve arrangement is operable to regulate fluid flow to and from the first and second double acting hydraulic cylinders independently of one another, hence actuating the first and second unbalanced masses independently of one another.

16. The method as recited in claim 14, wherein the valve arrangement includes first and second 4/3 way valves, each of which is connected to the pump, the storage unit, and both chambers of a respective one of the first and second double acting hydraulic cylinders.

17. A method of adjusting first and second unbalanced masses mounted on a common shaft on a vibration plate, the method comprising the steps of:

providing first and second double acting hydraulic cylinders, each of which has a piston connected to a respective one of the first and second unbalanced masses and first and second chambers disposed on opposite sides of the piston;

directing pressurized fluid from an outlet of a pump to the first chamber of at least one of the first and second double acting hydraulic cylinders while fluidly connecting the second chamber of the at least one double acting cylinder to an unpressurized storage unit in order to actuate the unbalanced mass associated with the at least one double acting cylinder; and operating a valve arrangement to regulate fluid flow to and from the first and second double acting hydraulic cylinders independently of one another, hence actuating the first and second unbalanced masses independently of one another.

18. The method as recited in claim 17, further comprising operating the valve arrangement to isolate the first and second chambers of the at least one double acting hydraulic cylinder from both the outlet of the pump and the unpressurized storage unit in order to fix the piston of the at least one double acting cylinder in position.

19. The method as recited in claim 18, wherein the valve arrangement includes first and second 4/3 way valves, each of which is connected to the pump, the storage unit, and both chambers of a respective one of the first and second double acting hydraulic cylinders.

* * * * *